US005485785A

United States Patent [19]

Schneider et al.

[11] Patent Number: 5,485,785

[45] Date of Patent: Jan. 23, 1996

[54] PROCESS AND DEVICE FOR ADJUSTING THE CONTACT PRESSURE OF A SYNTHETIC-BLANKET ROLLER IN ROTARY PRINTING PRESSES

[75] Inventors: Georg Schneider, Würzburg; Ewald Röthlein, Retzstadt, both of Germany

[73] Assignee: Koenig & Bauer Aktiengesellschaft, Wurzburg, Germany

[21] Appl. No.: 403,849

[22] Filed: Mar. 23, 1995

[86] PCT No.: PCT/DE93/00905

§ 371 Date: Mar. 23, 1995

§ 102(e) Date: Mar. 23, 1995

[87] PCT Pub. No.: WO94/07695

PCT Pub. Date: Apr. 14, 1994

[30] Foreign Application Priority Data

Sep. 25, 1992 [DE] Germany ..... 42 32 163.8

[51] Int. Cl.[6] ..... B41F 23/04

[52] U.S. Cl. ..... 101/487

[58] Field of Search ..... 101/487, 488, 101/348, 349, 350, 351, 352, 148, 216, 219, 329, 330, 331

[56] References Cited

U.S. PATENT DOCUMENTS

| | | | |
|---|---|---|---|
| 2,501,495 | 3/1950 | Carroll et al. | 101/487 |
| 3,131,631 | 5/1964 | Haskin . | |
| 3,691,956 | 9/1972 | James et al. . | |
| 3,888,173 | 6/1975 | Ritzerfeld . | |
| 4,037,531 | 7/1977 | Ritzerfeld . | |
| 4,502,386 | 3/1985 | Cappel et al. . | |
| 5,148,742 | 9/1992 | Stirbis et al. | 101/216 |
| 5,188,028 | 2/1993 | Reichel | 101/487 |
| 5,295,437 | 3/1994 | Philippe | 101/348 |
| 5,370,046 | 12/1994 | Spiegel et al. | 101/487 |
| 5,789,960 | 3/1993 | Valentini et al. | 101/349 |

FOREIGN PATENT DOCUMENTS

| | | |
|---|---|---|
| 0069976 | 1/1983 | European Pat. Off. . |
| 0094584 | 11/1983 | European Pat. Off. . |
| 2174055 | 10/1973 | France . |
| 2210020 | 6/1973 | Germany . |
| 2155496 | 3/1983 | Germany . |

*Primary Examiner*—Eugene H. Eickholt
*Attorney, Agent, or Firm*—Jones, Tullar & Cooper

[57] ABSTRACT

An apparatus and a process are used to maintain a set contact pressure per defined width of a roller mark of an ink application roller against a printing cylinder. The ink application roller is supported by a lever that has one portion biased against an adjustable stop. A temperature compensating element is provided between the lever and the stop to maintain the set contact pressure over a range of temperatures of the ink application roller.

8 Claims, 6 Drawing Sheets

PROCESS AND DEVICE FOR ADJUSTING THE CONTACT PRESSURE OF A SYNTHETIC-BLANKET ROLLER IN ROTARY PRINTING PRESSES

FIELD OF THE INVENTION

The invention relates to a process for maintaining a set contact pressure in the form of a roller mark of a metal roller provided with a synthetic blanket against a printing cylinder of a rotary printing press having a short inking unit, and to a device for executing the process.

DESCRIPTION OF THE PRIOR ART

A device for setting the contact pressure of ink application rollers against the printing cylinder is known from DE 21 55 496 C2, by means of which a reference ring is moved against cams, so that the shafts, of the ink application rollers, which are provided with resilient surfaces, can be adjusted in relation to the printing cylinder. The reference ring has an arm for this purpose, which can be adjusted by means of a set screw.

An inking unit is known from FR-A-73 06 691, wherein a temperature compensating device for a metering gap between a pivotably suspended metering roller and a transfer roller is said to be possible. The temperature compensating device only acts in response to room temperature changes. This prior art device may not be able to absorb the considerable hydrodynamic forces acting on the metering roller. This therefore may result in uneven ink metering.

It is disadvantageous in connection with the first mentioned prior art device that the subsequent adjustment, in respect to time as well as to the amount of the adjustment, of the pressure of the rubber roller takes place at the discretion of the operator after the rotary printing press has been placed in operation, so that a temperature-dependent ink supply to the printing cylinder cannot be ruled out.

SUMMARY OF THE INVENTION

It is the object of the invention to provide a process and a device for executing the process for an inking unit by means of which it is possible to keep the width of the so-called roller mark formed by pressure of the ink application roller against a printing cylinder approximately constant during temperature changes of the ink application roller.

The present invention provides a device and a process for maintaining a set contact pressure per defined width of a roller mark of an ink application roller provided with a synthetic or resilient cover, such as rubber, against a printing cylinder of a rotary printing press when the temperature of the roller or cylinder changes. The ink application roller is pressed against an adjustable detent or stop that is fixed on the press frame. Movement of the ink application roller toward or away from the printing cylinder is accomplished by use of a temperature compensating element as a function of the heating change of the ink application roller.

The following advantages in particular ensue in the course of utilizing the invention. By means of an always evenly formed roller mark, independently of the degree of heating of the rubber blanket, an even print quality is assured by means of even ink application. The subject of the invention is particularly advantageously employable in connection with Anilox offset short inking units and particularly in those cases where the printing cylinder and the ink application roller are of the same diameter. In addition, the tendency for scumming can be reduced. The invention is not limited to offset short inking units. The quantity of ink transferred from the ink application roller to a printing plate, for example an offset printing plate, of a printing cylinder over a temperature range between start-up temperature and operating temperature, and thus the quality of the transfer of the ink from the ink application roller to the printing plate can be kept approximately constant in this manner.

It is furthermore avoided that too strong a contact pressure might be created between the printing cylinder and the ink application roller and that therefore scumming occurs. Too strong a contact pressure can also lead to a kneading effect of the resilient or plastic covering of the ink application roller and thus to the destruction of the resilient covering.

BRIEF DESCRIPTION OF THE DRAWINGS

The invention will be explained in detail by means of several preferred embodiments. Shown in the associated drawings is in.

DESCRIPTION OF THE PREFERRED EMBODIMENTS

Figure 1:
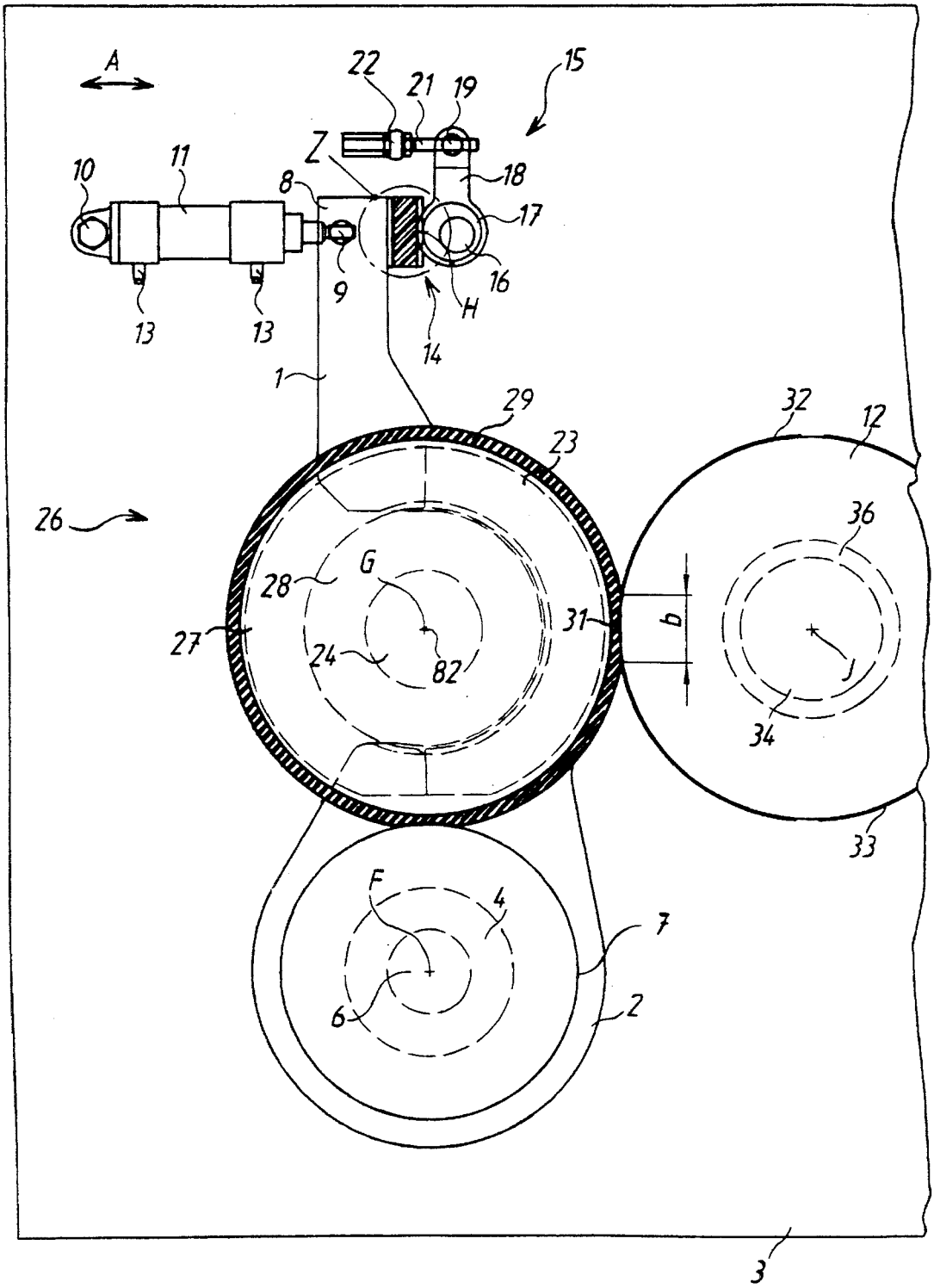
FIG. 1, a schematic lateral view of a short inking unit of a rotary offset printing press of Anilox construction with the device in accordance with the present invention.

A schematic lateral view of a short inking unit of Anilox construction is represented in FIG. 1. A first end 2 of a one-armed lever 1 is pivotably seated in the horizontal direction A in the side frame 3 of a printing press by means of a bearing 4 on a journal 6 of a screen roller 7 of the Anilox type which is seated fixed on the frame. An ink supply element for the screen roller 7 is not shown to simplify matters. A second end 8 of the lever 1 is connected with an end of a piston rod 9 of a double-acting working cylinder 11. In this case, the end of the piston rod 9 can be embodied as an eye and can be connected via a threaded bolt with the second end 8 of the lever 1. On its two ends, the working cylinder 11 has connectors 13 for the supply and removal of the fluid, for example hydraulic oil or compressed air, from an appropriate installation, not shown. The lever 1 can be made of sheet steel of a thickness of ten to fifteen millimeters. The second end 8 of the lever 1 can be moved in accordance with the direction of travel indicated by the arrow A in the direction of a printing cylinder 12 as far as a detent or stop that is identified generally by 15, with the special feature that between the detent or stop 15 and the second end 8 of the lever 1, a temperature compensating element, identified generally at by 14, is disposed. The element 14 is connected with the front face of the second end 8 of the lever 1, for example by screws, and is explained more extensively as the detail Z in FIGS. 2 and 3.

The detent 15 consists of a bolt 16, fixed to the frame, on which an eccentric 17 and a first end of a lever 18 are sequentially received in the axial direction. A second end of the lever 18 is connected with a threaded bolt 21 via a joint 19. The joint 19 here consists of a hinged bolt with a threaded bore extending at right angles in respect to its longitudinal axis, in which the threaded bolt 21 is seated. The threaded bolt 21 is passed through a bore of a bearing block 22 fixed on the frame and is provided with a turning grip. In this way the detent 15 can be roughly adjusted by means of the eccentric 17 and can be finely adjusted by means of the threaded bolt 21 acting on the lever 18.

A semicircular holder 23 for receiving an axle journal 24 of an ink application roller, identified by 26 as a unit, extends approximately in the center between the two ends 2, 8 of the one arm lever 1 and can be closed off by means of a removable supporting element 27 in the manner of known roller blocks. A bearing 28 is disposed between the holder 23 or a bearing cup 27 and the axle journal 24. A known rubber covering 29 or rubber layer or a blanket made of rubber or a rubber mixture has been pulled on the jacket surface of the ink application roller 26. The surface of the rubber covering 29 is in permanent contact with the surface of the screen roller 7, which delivers the ink from its cell to the ink application roller 26.

Figure 2:
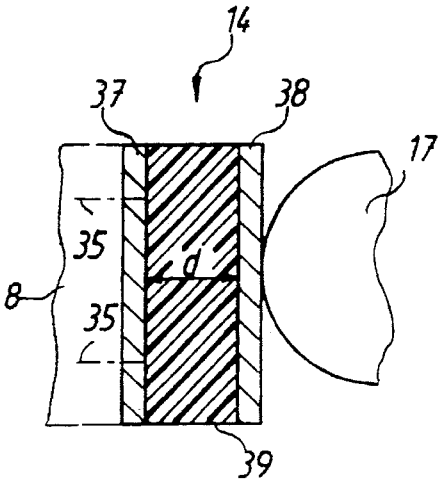
FIG. 2, a detailed representation of a detail "Z" of FIG. 1.

By means of the working cylinder 11, the ink application roller 26 can be placed against the adjustable detent 15 via the element 14. This takes place in the idle state of the press and has the effect that the printing cylinder 12 presses on the rubber covering 29 of the ink application roller 26 with a defined pressure force and generates a roller mark 31 or a flattening of a width "b". The printing cylinder 12 is seated fixed on the frame by means of bearing journals 34 and bearings 36 next to the ink application roller 26. An element 14 corresponding to the detail Z of FIG. 1 is represented in FIG. 2. The element 14 is releasably connected with the front face of the lever 1 on its second end 8 by means of screws 35 indicated in the drawings. The element 14 consists of two strip-shaped metal plates 37, 38, made of steel, for example, between which a thicker, cuboid temperature effect compensator 39 of plastic of a thickness "d" and of the same length and width is disposed in a "sandwich" construction, for example by gluing. In the operational state, the exterior of the metal plate 38 of the element 14 facing the printing cylinder 12 rests against the eccentric 17 of the detent 15.

All of the above mentioned components or elements of the device are each provided twice, but not shown or identified separately. Such components are, for example, the lever 1, the bearings 4, 28, the axle journal 6 and the like. This also applies to components 41 to 106 which will be discussed shortly, but not to the printing cylinder 12, the ink application roller 26 with the rubber covering 29 and the screen roller 7.

The device operates as follows. Because of interior friction in the rubber covering 29 of the ink application roller 26, heat is generated during operation, which results in an expansion of the rubber covering 29 and therefore an increase in the exterior diameter of the ink application roller 26. This normally leads to an increase in the width "b" of the roller mark 31 and therefore to a widened mark formation which, in turn, results in a bad print quality. To compensate for the increase of the roller mark 31 during heating, in the idle state of the press, the roller mark 31 was set to the width "b". The temperature effect compensator 39 of the element 14 now expands under the effect of heat, so that the second end 8 of the lever 1 moves in the direction of the working cylinder 11, so that in this way the pressure force between the rubber covering 29 of the ink application roller 26 and the printing plates 32, 33 of the printing cylinder 12 remains the same.

Therefore, the width "b" of the roller mark 31, extending in the axial direction of the ink application roller 26, remains constant and thus the quality of the printed image also remains constant.

In this case the plastic strip 39 of the temperature compensating element 14 can be made of polyamide PA 12 in accordance with DIN 7728, for example, with a linear expansion coefficient of $150 \cdot 1^{-6}$ $K^{-1}$, which also corresponds with a linear expansion coefficient of the rubber covering 29 of the ink application roller 26. Based on the representation of FIG. 1, the ratio of the imagined distances between the points F and G as well as F and H is one to two. In this case the point F represents the turning or pivot point of the lever 1, the point G identifies the axis of rotation of the ink application roller 26 and the point H identifies the contact point or the contact line between the element 14 and the eccentric 17 of the detent 15. With the above mentioned equal expansion coefficients of the rubber covering 29 and of the temperature effect compensator 39 and with the above mentioned lever ratio of one to two it is necessary for the temperature effect compensator 39 to expand by two millimeters so that the cylinders 12, 26, arranged with their axes of rotation in one plane, move away from each other by one millimeter, i.e. that the width "b" of the roller mark 31 decreases. Therefore the thickness "d" of the plastic body 39 of the element 14 in the arrangement of the printing press cylinders represented in FIGS. 1 and 4 corresponds to twice the amount of the thickness of the rubber covering 29 on the ink application roller 26.

With the employment of a material for a temperature effect compensator 39 with a linear expansion coefficient of twice that of the mentioned polyamide PA12 and the same thickness "d" of the material 39 of the rubber covering 29, the result is that a roller mark 31 of even width is always assured. The heat generated during operation of the ink application roller 26 is passed on via the levers 1 to the temperature compensating elements 14 located on the second ends 8 of the levers 1 and causes the heat expansion of the elements 14. However, in actuality, heating of the rubber covering 29 occurs continuously during operation so that the element 14 also experiences heating via the lever 1. This again results in an even expansion of the temperature effect compensator 43 and therefore a constant width b of the roller mark 31.

Figure 3:
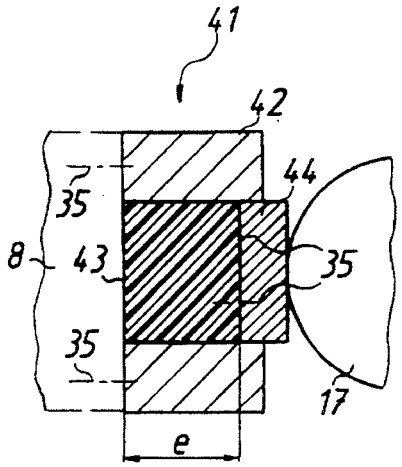
FIG. 3, a detailed representation of a detail "Z" of FIG. 1, in accordance with a second preferred embodiment.

A second preferred embodiment of a temperature compensating element is represented at 41 in FIG. 3. A metallic support or a metallic sleeve 42 made of, for example, steel is releasably connected by means of screws 35 with the front face of the second end 8 of the lever 1 and has a bore centered in the direction of its thickness "e," which is filled by a cylinder-shaped temperature effect compensator 43 of plastic. The front face of the cylinder-shaped temperature effect compensator 43, facing away from the second end 8 of the lever 1, is connected with a metal disk 44, for example of steel, by indicated screws 35, for example. This metal disk 44 is used for the accurate adjustment of the element 41 in relation to the detent or stop 15 with the eccentric 17. The mode of operation of the element 41 of FIG. 3 corresponds to that of the element 14 in FIG. 2.

Figure 4:
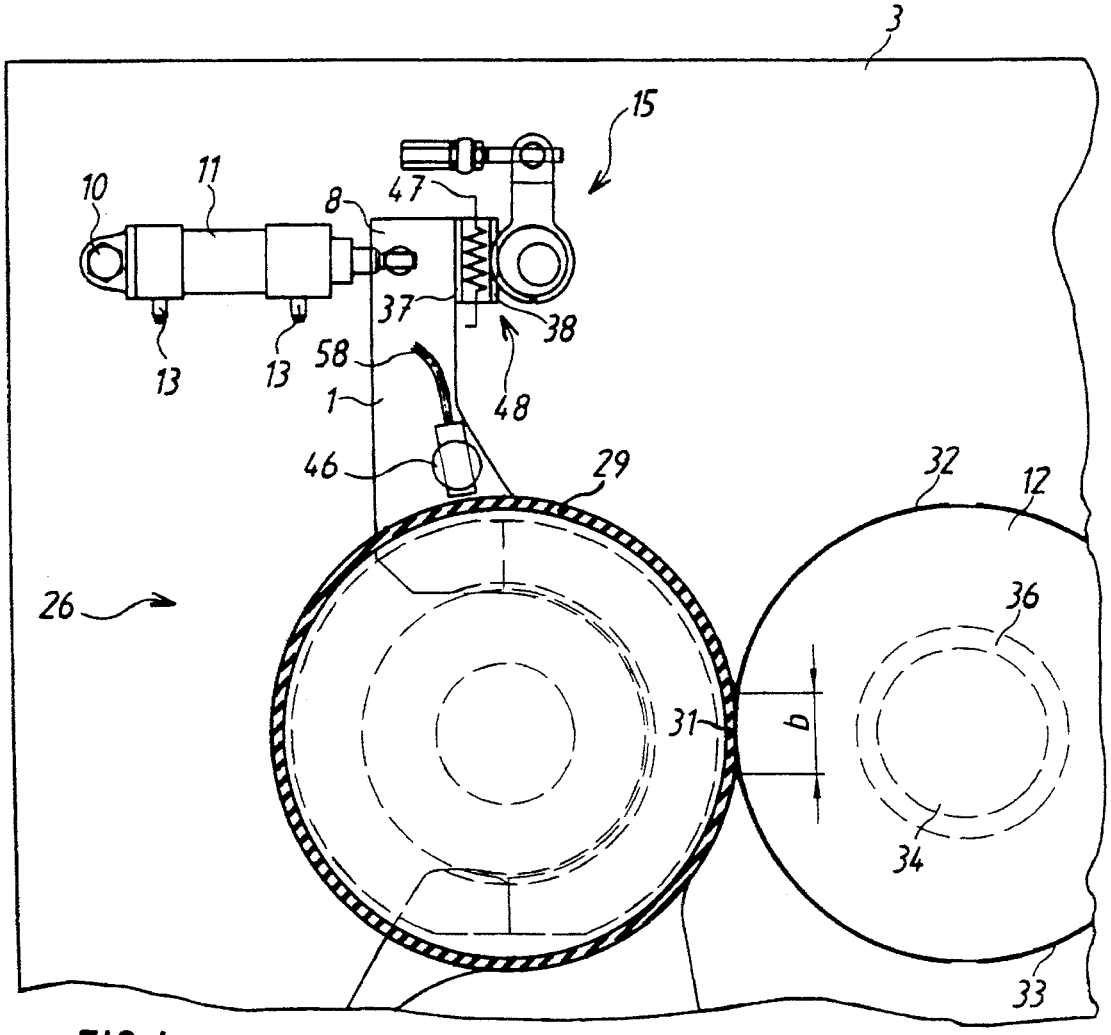
FIG. 4, the schematic representation of a third preferred embodiment of the device in accordance with the invention.

A third preferred embodiment of the device in accordance with the invention is shown in FIG. 4. A known thermal sensor 46 is disposed above the ink application roller 26 on the lever 1. This sensor 46 measures the temperature on the surface of the rubber covering 29 of the ink application roller 26 during operation and reports it to a computer 61 and an amplifier 66, represented in FIG. 9, which operates a heat source 47, for example a heating cartridge in a temperature compensating or control element 48, until the material between the two metal plates 37, 38 in which the heating source 47 is embedded expands because of its being heated in such a way that the roller mark 31 remains constant in its width "b." Analogously to the element 14 of FIG. 1, the temperature compensating or control element 48 is connected with the front face of the lever 1 by screws 35. The material between the plates 37, 38 can consist of plastic, for example polyamide. In this preferred embodiment it is assured by means of the temperature measurement at the rubber covering 29 that the control element 48 is heated by the heat source 47 and expanded only to the extent that an always constant width "b" of a roller mark 31 is assured.

Figure 5:
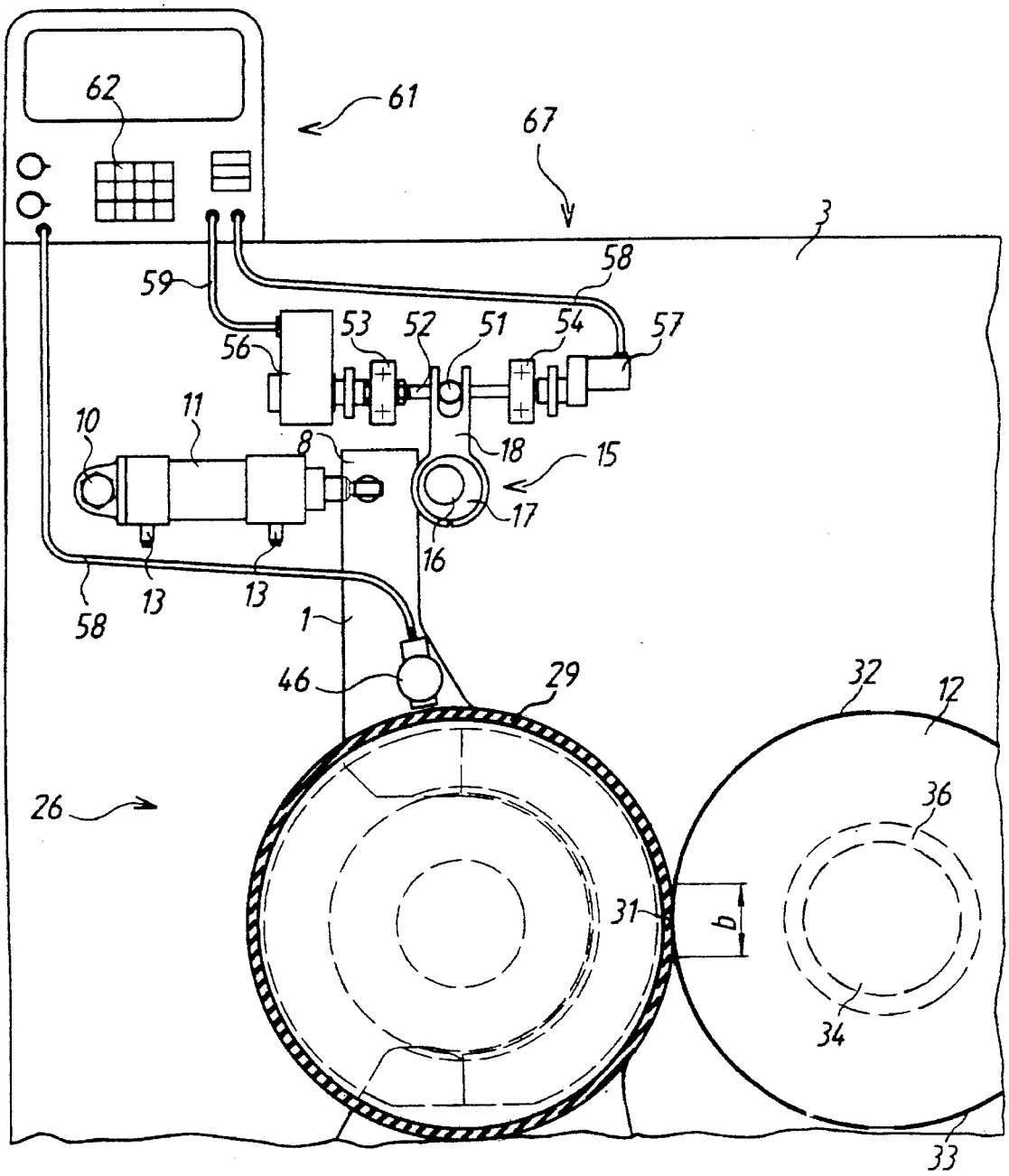
FIG. 5, the schematic representation of a fourth preferred embodiment of the device in accordance with the invention.

A fourth preferred embodiment of a device in accordance with the invention is shown in FIG. 5. The lever 18, disposed pivotably with its first or lower end on the bolt 16 fixed to the frame, has a forked guide 49 on its second or upper end, by means of which a sliding pad 51 is moved. The sliding pad 51 can be shifted along a spindle 52 by means of an interior thread which is engaged by the threaded spindle 52 seated in bearing blocks 53, 54 fixed to the frame. The ends of the threaded spindle 52 located outside the bearing blocks 53, 54 either receive a motor 56 fixed to the frame or are connected with a potentiometer 57 fixed to the frame. The motor 56 and the potentiometer 57 are each connected via cables 58, 59 with a symbolically represented computer 61. In accordance with FIGS. 5 and 6, parameters 63, 64 regarding the heat expansion coefficient and the thickness of the rubber covering 29 of the ink application roller 26 are entered into the computer 61 by means of a keyboard 62. The thermal sensor 46 provides the computer 61 with the actual value of the temperature of the rubber covering 29. The position of the sliding pad 51 and therefore the position of the lever 18 with the eccentric 17 in relation to the second end 8 of the lever 1 is known by means of the potentiometer 57. The computer 61 calculates a set value from the supplied data, which is supplied via an amplifier 66 to the motor 56, which turns the threaded spindle 52 until the eccentric 17 has moved the lever 1 through its front face against the force of the working cylinder 11 so that the desired width "b" of the roller mark 31 is set. The temperature compensating element or device for adjusting the eccentric 17 in relation to the front face of the second end 8 of the lever 1 is identified by 67 as a unit in this fourth preferred embodiment.

Figure 7:
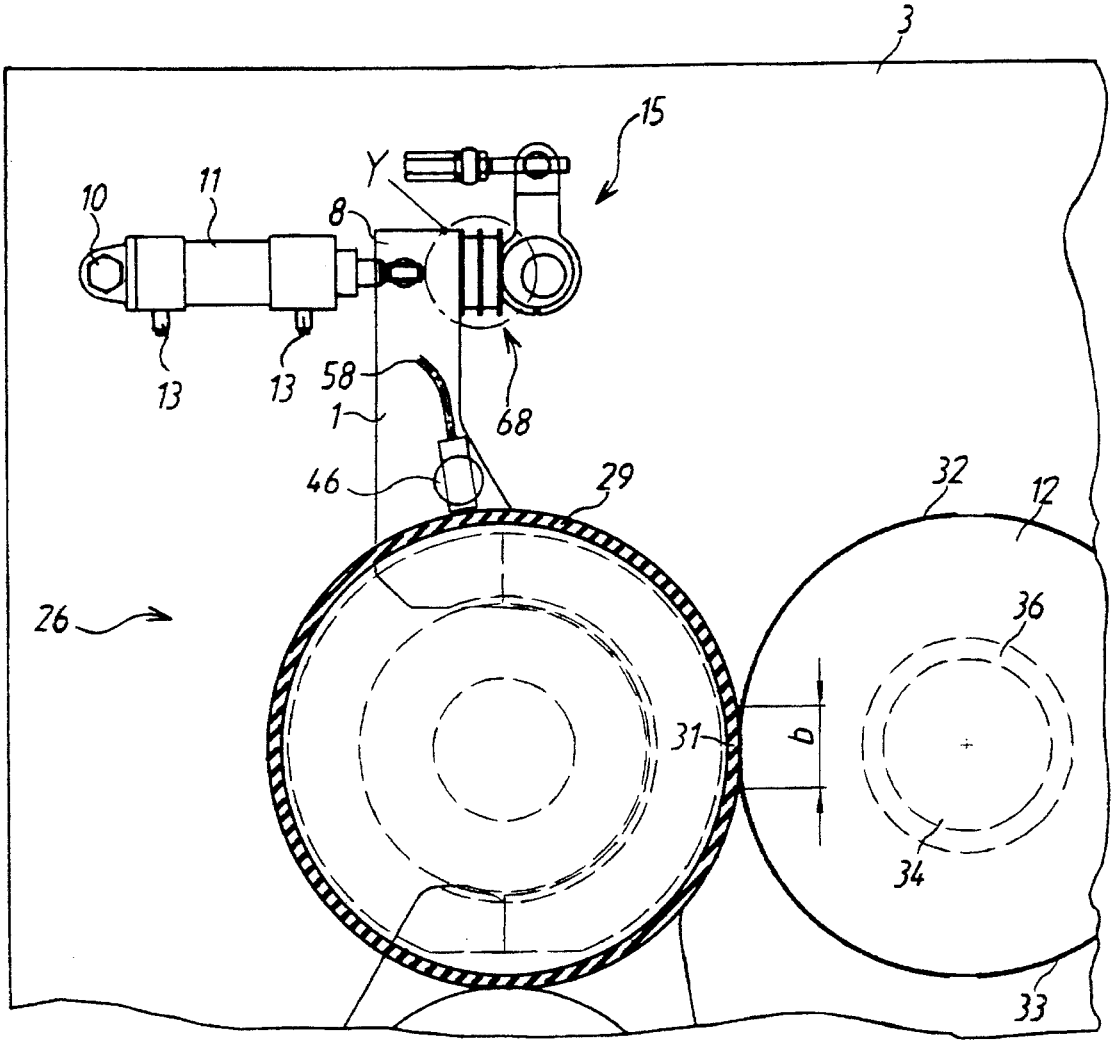

A fifth preferred embodiment of a device in accordance with the invention is shown in the representation of FIG. 7, wherein a control member or temperature compensating element, identified by 68 as a unit, is connected to the front face of the second end 8 of the lever 1 by means of screws 35, analogously to the temperature compensating or control element 48 of FIG. 4. The control element 68 is also manufactured in "sandwich construction" and, in accordance with FIG. 8, has three parallel extending metal plates 69, 71, 72 disposed at distances i1 and i2 from each other, between which piezo-electrical force generators 73, 74 are located.

If the force generators 73, 74 are now charged with dc voltage via the metal plates 69, 71, 72, wherein the metal plate 71 centered between the force generators 73, 74 must always have a different polarity than the two metal plates 69, 72 resting against the outside of the force generators 73, 74, the thicknesses or distances i1 and i2 also change either positively or negatively as a function of the above mentioned polarity.

Figure 6:
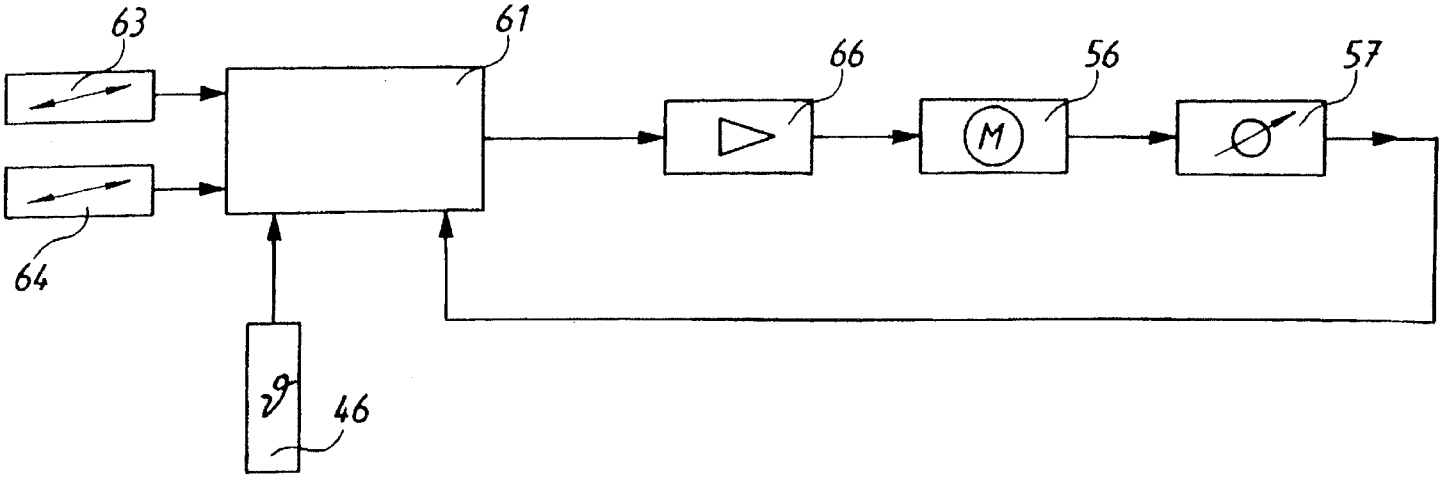
FIG. 6, a block diagram in connection with the preferred embodiment of FIG. 5, FIG. 7, a schematic representation of a fifth preferred embodiment of the device in accordance with the invention.
Figure 9:
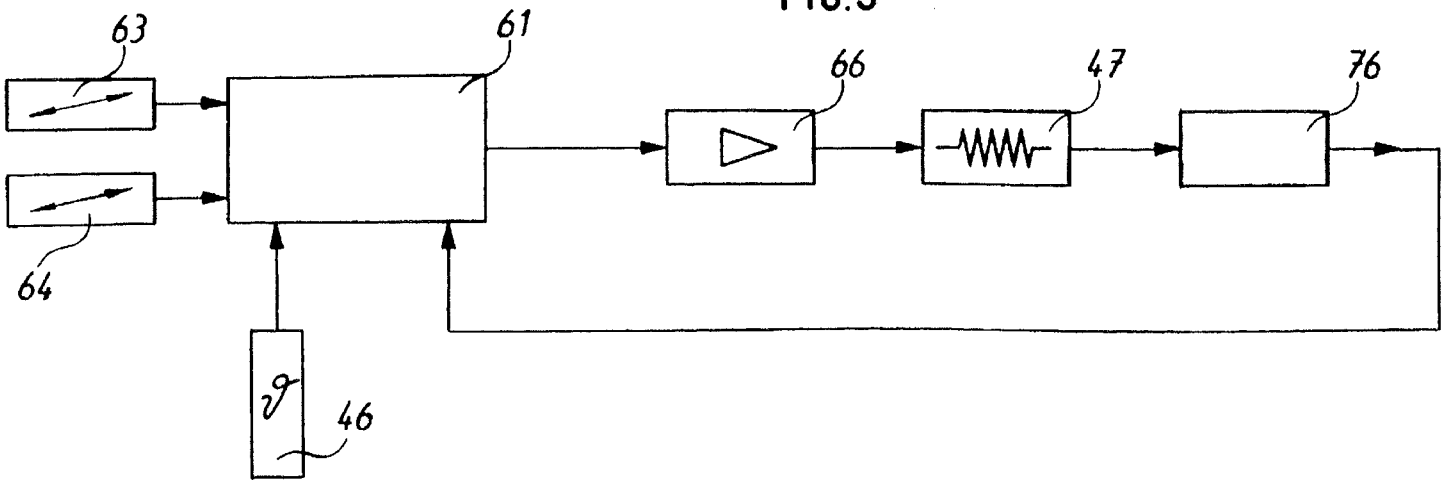
FIG. 9, a block diagram in connection with the third preferred embodiment of FIG. 4, FIG. 10, a schematic representation of a sixth preferred embodiment of the device in accordance with the invention.

The temperature compensating or control element 48 represented in FIG. 4 with the heat source 47 disposed therein can be controlled via the computer 61 in accordance with the representation of FIG. 9, as described in FIG. 6, with the special feature that an inductive distance sensor 76 is disposed which measures the expansion "d", see FIG. 2 with the element 14, and transmits this actual value to the computer 61.

Figure 8:
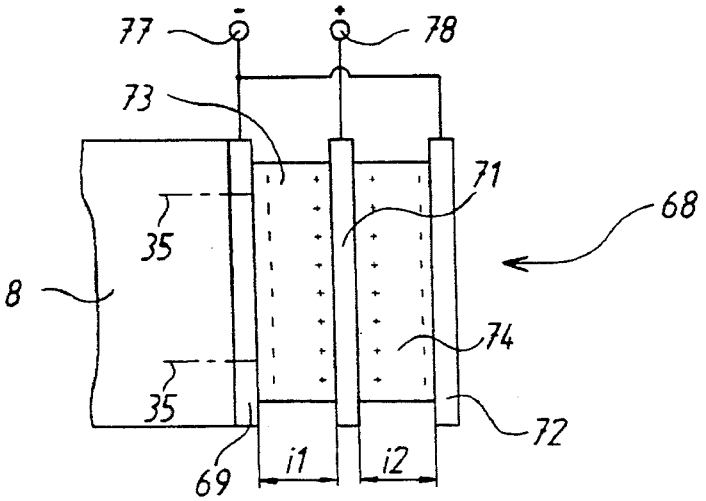
FIG. 8, a detailed representation of a detail Y of FIG. 7.

In the same way, the temperature compensating or control element 68 shown in FIG. 8 can be controlled in accordance with FIG. 9 by means of the computer 61. For this purpose the heat source 47 is replaced by the control element 68 with the connectors 77, 78.

Figure 10:
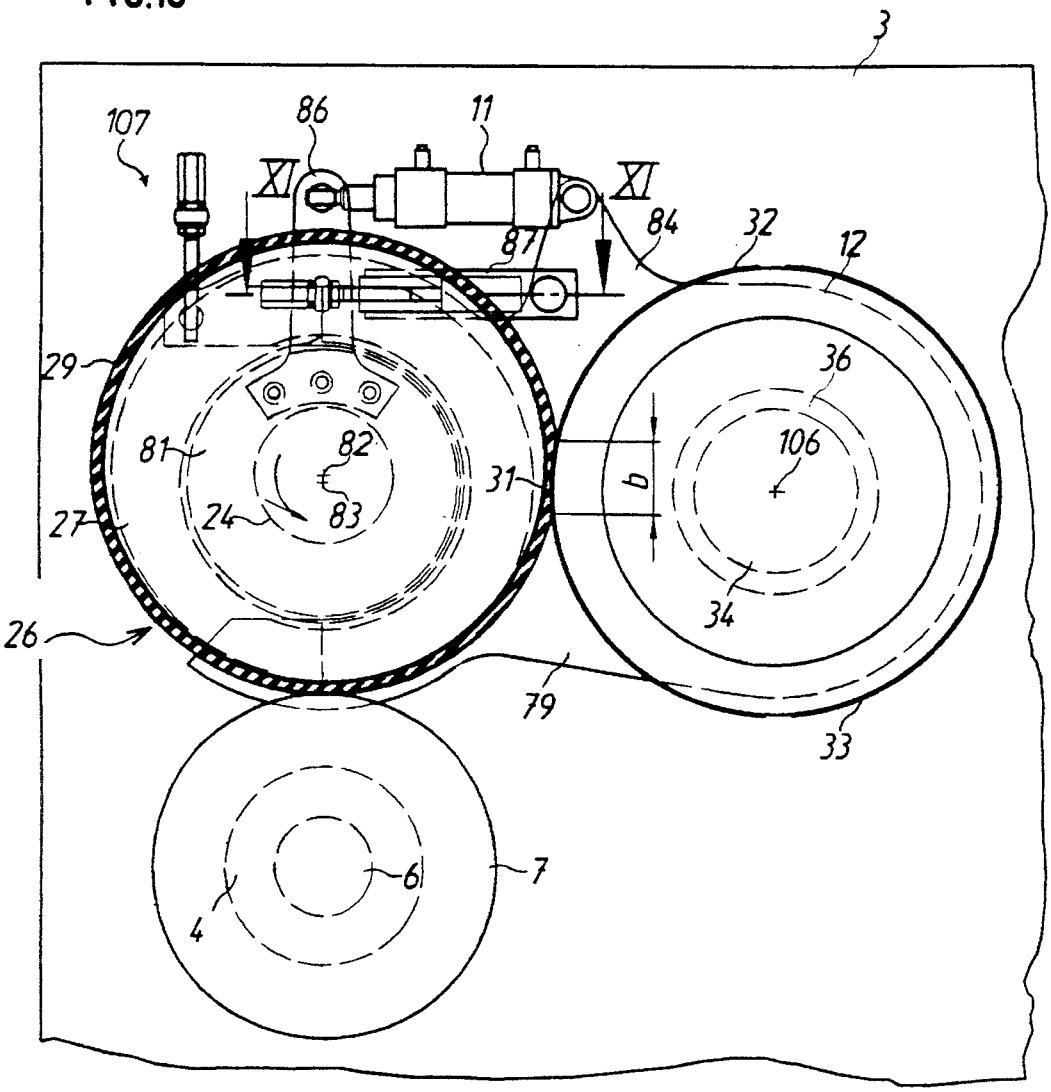
Figure 11:
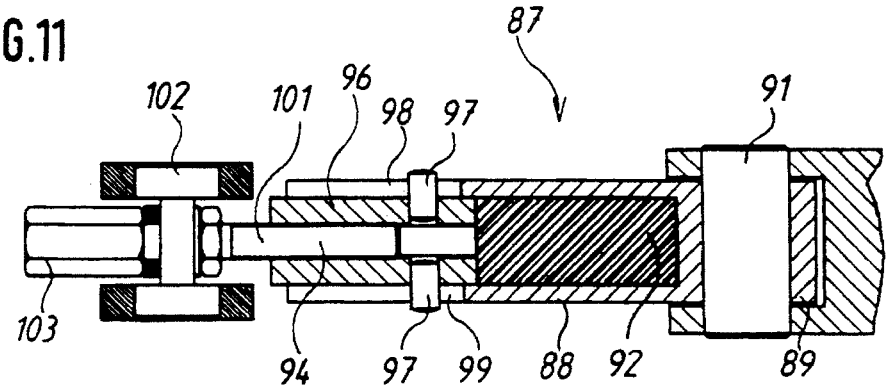
FIG. 11, a section XI—XI in accordance with FIG. 10.

A further or sixth preferred embodiment of the invention is illustrated in the representation of FIG. 10. A printing cylinder 12 with printing plates 32, 33 is seated in a bearing 36 in the side frame of the press by means of its bearing journal 34. A holder 79 is also seated on the bearing journal 34 of the printing cylinder 12, and receives an eccentric bushing 81 for an axle journal 24 of an ink application roller 26 with a rubber covering 29. The axis of rotation of the axle journal 24 of the ink application roller 26 is identified by 83. A bearing cup 27 encloses the eccentric bushing 81 and is connected with the holder 79. The journals 24, 34 of the ink application roller 26 or of the printing cylinder 12 are disposed by means of the holder 79 at such a distance from each other that the surfaces of the cylinder 12 and the roller 26 touch each other and result in a roller mark 31 of the width "b". In order to be able to automatically vary the width "b" of the roller mark 31 as a function of the heating of the rubber covering 29, a detent or stop in the form of a projection, identified by 84, and a lever 86 fastened on the eccentric bushing 81 are provided, between which a temperature compensating element 87 is disposed. The element 87 is shown enlarged in FIG. 11 and consists of a sleeve 88, whose first end 89 is hingedly connected via a journal 91 with the detent 84 of the holder 79. For receiving the first end 89 of the sleeve 88, the detent 84 has a milled cutout, not identified in detail. A temperature effect compensator 92, for example made of polyamide, having the same heat expansion coefficient as that of the rubber covering 29 of the ink application roller 26, is located in the sleeve 88. Following the temperature effect compensator 92 in the direction of the second end 93 of the sleeve 88, a sliding element 96, provided with a threaded bore 94 and movable in the axial direction of the sleeve 88, is disposed in the sleeve 88.

On its end facing the temperature effect compensator 92, the sliding element 96 has a pin 97 passing through the sliding element 96 in the radial direction, and whose respective ends are guided in a slot 98, 99 extending in the axial direction in the sleeve 88 and which in this way is secure against twisting. An adjustment screw 101 is rotatably disposed in the threaded bore 94 of the sliding element 96 and passes through a bearing 102 with a threaded bore. The bearing 102 is fastened on the lever 86 connected with the eccentric bushing 81. An actuating element 103, for example a square, is provided at the end of the adjustment screw 101 for turning the adjustment screw 101 and thus for presetting the roller mark 31.

A disk spring package 104 is provided between the actuating element 103 and the bearing 102. A working cylinder 11 is disposed as a spring between the upper end of the level 86 and the upper end of the detent 84 parallel with the temperature compensating element 87. In the course of the expansion of the temperature effect compensator 92, made of plastic, in the temperature compensating element 87 analogously to the element 41 in FIG. 3, the plastic body 92 expands under the effect of heat and moves the sliding element 96 in the axial direction of the adjustment screw 101, so that the eccentric bushing 81 is turned counterclockwise via the lever 86 and the axis of rotation 82 of the axle journal 24 of the ink application roller 26 moves away from an axis of rotation 106 of the printing cylinder 12, so that the roller mark 31 continues to maintain its width "b" in spite of the heat expansion. The axle journal 6 of the screen roller 7 is seated fixed on the frame and centered by means of a bearing 4. The contact pressure or the distance between the axle journal 6 of the screen roller 7 and the axle journal 24 of the ink application roller 26 can be set by means of a setting device 107 fixed on the frame, i.e. by turning a control element analogous to the one with the reference numeral 103, it is possible to adjust the holder 79, which is pivotable around the axis of rotation 106 of the plate cylinder 12, in relation to the screen roller 7.

It is also possible to employ a distance measuring device in place of the thermal sensor 46 which is depicted in FIG. 4, for example a laser measuring device or an infrared distance measuring device. As represented in FIGS. 4 and 5, this distance measuring device can be fastened on the lever 1 and measures the distance to the surface of the ink application roller 26 that is provided with the rubber covering 29 at intervals. Different from the input parameters 63, 64, which provide information regarding the heat expansion coefficient and the thickness of the rubber covering 29, the following parameters are also input as set values into the computer 61 in accordance with FIGS. 6 and 9. The diameter of the ink application roller 26 and the printing cylinder 12, the length of the lever 1 from the stop or turning point F to the detent 15, length of the lever 1 from the turning point F to the axis of rotation G of the ink application roller 26. By means of a program stored in the computer 61, the drive elements for changing the distance between the ink application roller 26 and the printing cylinder 12, represented symbolically in FIGS. 6 and 9, are put into operation on the basis of the change of the distance between the surface of the ink application roller 26 and the distance measuring device.

We claim:

1. A process for maintaining a set contact pressure per defined width of a roller mark of an ink application roller provided with a resilient covering against a printing cylinder of a rotary printing press during temperature changes of the printing cylinder including the steps of:

supporting said ink application roller in a lever arm having an upper end and a lower end;

connecting said lever arm to a frame of said press for pivotal movement;

providing an adjustable stop on said frame;

using said adjustable stop to shift said lever arm to define said roller mark;

utilizing means to bias said lever arm against said adjustable stop;

interposing a temperature compensating element between said lever arm and said adjustable stop; and using said temperature compensating element to automatically shift said ink application roller with respect to said printing cylinder in response to heating changes of said ink application roller.

2. A device for maintaining a set contact pressure per defined width of a roller mark in a rotary printing press comprising:

a one armed lever having a first end and a second end with said first end being supported for pivotal motion in a side frame of the printing press;

an ink application roller having a resilient cover and supported for rotation by said one armed lever intermediate said first and second ends;

an adjustable stop secured to said side frame;

means to bias said one armed lever toward said adjustable stop to bring said resilient cover of said ink application roller into contact with a printing cylinder at a set contact pressure; and means interposed between said adjustable stop and said one armed lever for generating an automatic movement of said ink application roller with respect to a printing cylinder in response to heating changes of said ink application roller to maintain said roller mark at a desired width.

3. The device of claim 2 wherein said means for generating an automatic movement of said ink application roller is a temperature effect compensator.

4. The device of claim 3 wherein said temperature effect compensator is a heat sensitive, linearly expandable plastic.

5. The device of claim 3 wherein said temperature effect compensator is a heat source disposed in plastic.

6. The device of claim 3 wherein said temperature effect compensator includes piezo-electric force generators disposed between metal plates.

7. The device of claim 3 wherein said temperature effect compensator includes a threaded spindle driven by an electric motor.

8. The device of claim 4 further including a thermal sensor positioned adjacent said resilient cover of said ink application roller and a computer connected to said temperature effect compensator, said thermal sensor providing temperature information to said computer for use by said computer to actuate said temperature effect compensator.

* * * * *